7/31/84 OR 4,462,469

United States Patent [19]

Brown

[11] Patent Number: 4,462,469

[45] Date of Patent: Jul. 31, 1984

[54] FLUID MOTOR AND TELEMETRY SYSTEM

[75] Inventor: Robert L. Brown, Buena Park, Calif.

[73] Assignee: AMF Inc., White Plains, N.Y.

[21] Appl. No.: 284,729

[22] Filed: Jul. 20, 1981

[51] Int. Cl.[3] ..... E21B 4/02

[52] U.S. Cl. ..... 175/40; 175/93; 175/107

[58] Field of Search ..... 175/40, 45, 93, 107

[56] References Cited

U.S. PATENT DOCUMENTS

| | | | |
|---|---|---|---|
| 3,791,043 | 2/1974 | Russell | 33/312 |
| 3,862,499 | 1/1975 | Isham | 33/312 |
| 3,908,770 | 9/1975 | Richter | 175/93 |
| 3,964,556 | 6/1976 | Gearhart | 175/45 |
| 4,078,620 | 3/1978 | Westlake | 175/48 |
| 4,098,359 | 7/1978 | Birdwell | 175/93 |
| 4,181,014 | 1/1980 | Zuvela | 73/151 |
| 4,211,291 | 7/1980 | Kellner | 175/93 |
| 4,283,779 | 8/1981 | Lamel | 175/40 |
| 4,351,037 | 9/1982 | Scherbatskoy | 175/40 |

*Primary Examiner*—William F. Pate, III

*Attorney, Agent, or Firm*—David E. Dougherty; John H. Gallagher

[57] ABSTRACT

A motor for driving a rotary drilling bit within a well through which mud is circulated during a drilling operation, with the motor being driven by a secondary fluid which is isolated from the circulating mud but derives energy therefrom to power the motor. A pressure drop in the circulating mud across a choke in the drill string is utilized to cause motion of the secondary fluid through the motor. An instrument which is within the well and develops data to be transmitted to the surface of the earth controls actuation of the motor between different operating conditions in correspondence with data signals produced by the instrument, and the resulting variations in torque in the drill string and/or the variations in circulating fluid pressure are sensed at the surface of the earth to control and produce a readout representative of the down hole data.

8 Claims, 13 Drawing Figures

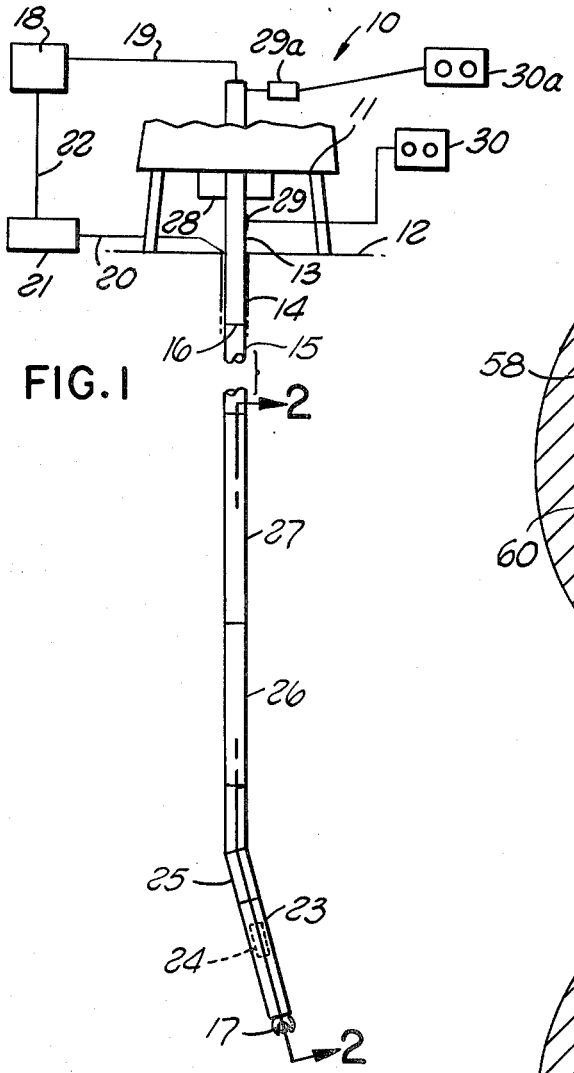
FIG. 1
FIG. 3
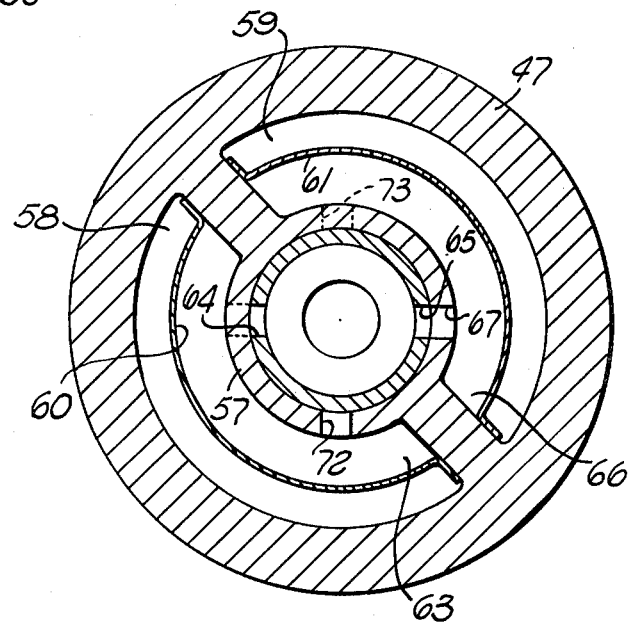
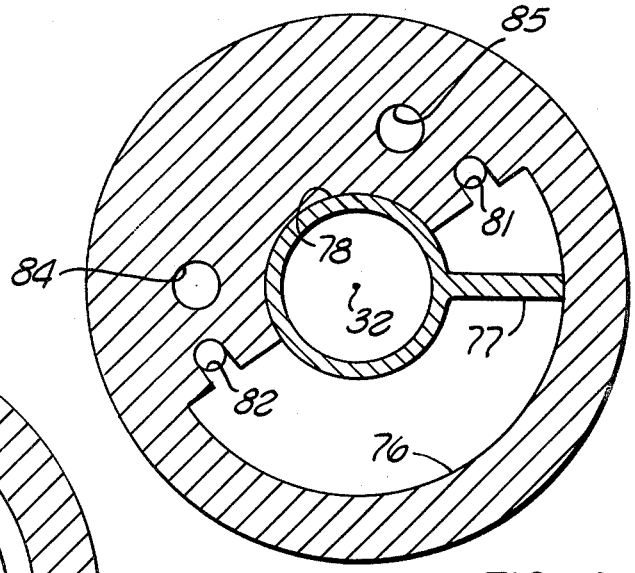
FIG. 4
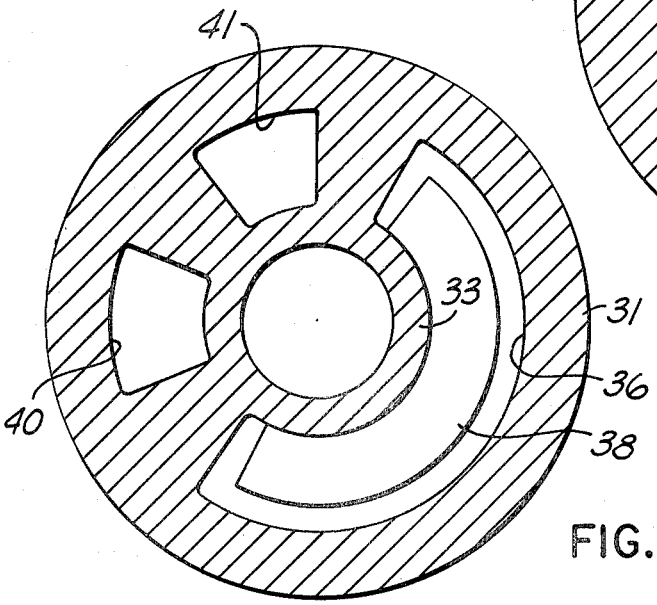
FIG. 5

FLUID MOTOR AND TELEMETRY SYSTEM

BACKGROUND OF THE INVENTION

This invention relates to an improved fluid driven motor and an associated telemetry system for transmitting data from one location to another. The invention is in certain respects especially useful as adapted to a down hole well drilling motor and a telemetry system for transmitting information from an instrument within a well to the surface of the earth, and will be described primarily as applied to that use.

Most directional drilling of oil or gas wells or the like is performed with drilling units including a motor which is lowered into the well at the bottom of a drill string and acts to drive a connected bit without rotation of the upper part of the string above the motor. A bent sub is connected into the string above the drilling unit to deflect it slightly laterally for attaining the desired directional drilling effect. In most instances, the motor is driven by the pressure of circulating fluid or mud which is pumped downwardly through the drill string and after passing through the motor is discharged at the bit to carry cuttings upwardly about the outside of the string.

Mud motors of this type are subject to a very rapid wear as a result of their continual contact with the highly abrasive circulating fluid which drives the motor, and consequently such a motor can only operate for relatively short period of time before it must be removed from the well and overhauled or replaced.

With regard to prior telemetry systems, the most common method of transmitting information from a steering tool, surveying tool, or other instrument located within a well has been by lowering the instrument into the well on a wire line and conducting electrical signals upwardly to the surface through that line. Such use of a wire line is for many reasons very inconvenient and expensive, and involves substantial losses in rig time in raising and lowering the instrument each time a pipe section is added to the drill string. Other telemetry systems utilized in wells have included arrangements in which electrical signals have been transmitted to the earth through the metal of a drill string and/or the surrounding earth formation, or have been converted to variations in pressure of the circulating fluid with those variations being controlled by the down hole instrument and being sensed at the surface of the earth.

SUMMARY OF THE INVENTION

The present invention provides for the driving of a down hole motor by energy derived from the mud circulating through the drill string but without permitting that mud to contact the moving parts of the motor itself. To attain this result, a secondary fluid is employed to drive the motor, and that secondary fluid is in turn energized by the pressure of the circulating mud. Preferably, a choke is introduced into the path of travel of the mud in a relation causing a substantial pressure drop between opposite sides of the choke, and that differential pressure is then utilized to cause flow of the secondary fluid through the motor to drive it and the bit. The pressure upstream and downstream of the choke or restriction is communicated to two different chambers respectively, with the connections to those chambers being reversed intermittently so that first one chamber is at the higher pressure and then the other chamber is at the higher pressure. The pressures in the two chambers may be communicated through flexible bellows or other similar movable walls to corresponding chambers containing the secondary fluid to alternately pressurize those two chambers, with their alternating pressures being delivered to the motor through additional reversing valve means for rotating the motor in a desired direction. The secondary fluid may be hydraulic hydrocarbon liquid haivng lubricating characteristics for continuously and very effectively lubricating the inner working parts of the main bit driving motor in a manner assuring its very long operating life.

This motor assembly is utilized in unique manner for transmission of data from a down hole instrument to the surface of the earth by controlling actuation of the motor between its different conditions in correspondence with data signals from the instrument. The control of the motor may be such as to decrease or interrupt the bit driving torque of the motor intermittently and at intervals dependent upon the information derived from the instrument, with the result that the torque in rhe drill string is correspondingly decreased or interrupted upon each such change in condition of the motor. The changes in condition of the motor may also or alternatively cause variations in the pressure of the circulating mud in the drill string. The variations in drill string torque and/or in mud pressure may be sensed at the surface of the earth and employed to produce an indication of the down hole data on a readout instrument, or to produce another output dependent upon or indicative of that data. Preferably, the changes in condition of the motor are effected in a manner interrupting the delivery of energizing secondary fluid to the motor each time that the previously mentioned second reversing valve means change condition, to thus produce a decreasing torque pulse and increasing mud pressure pulse at each such interval, with the timing of such pulses being employed to indicate the values sensed by the instrument and to be transmitted to the surface of the earth.

BRIEF DESCRIPTION OF THE DRAWINGS

The above and other features and objects of the invention will be better understood from the following detailed description of the typical embodiments inlustrated in the accompanying drawings, in which:

FIG. 1 is a diagrammatic representation of a well-drilling assembly constructed in accordance with the invention;

FIGS. 3, 4, 5, 6 and 7 are enlarged horizontal sections taken on lines 3—3, 4—4, 5—5, 6—6 and 7—7 respectively of FIG. 2;

DESCRIPTION OF THE PREFERRED EMBODIMENTS

Figure 2:
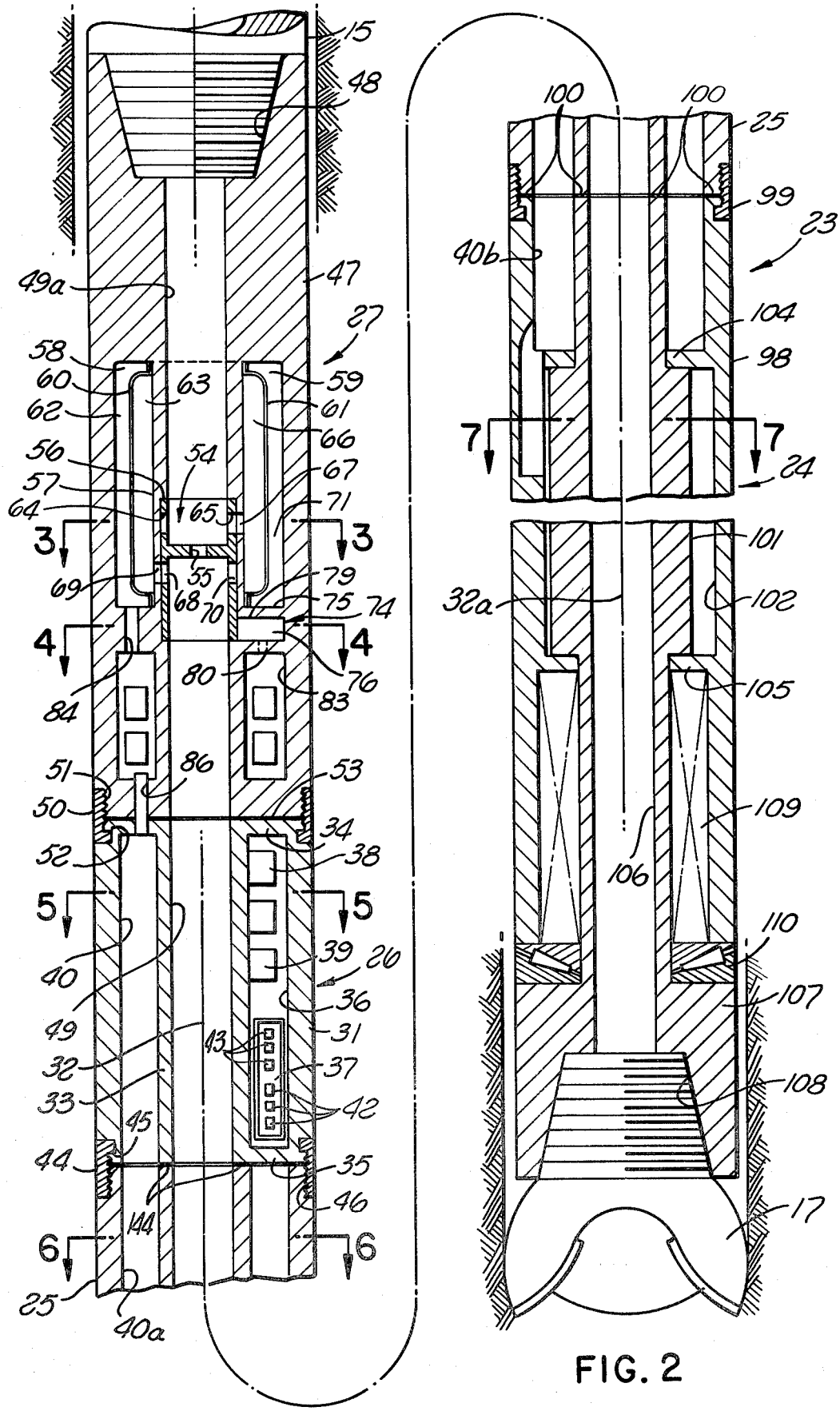
FIG. 2 is an enlarged fragmentary vertical section taken on line 2—2 of FIG. 1.

With reference first to the form of the invention shown in FIGS. 1 through 9, FIG. 1 illustrates diagrammatically at 10 a well drilling rig having a rig floor 11 spaced above the earth's surface 12 and through which a drill string 13 extends downwardly to drill a well 14 into the earth. The drill string is formed in conventional manner of a series of pipe sections 15 interconnected in end-to-end relation by threaded joints 16 and carrying a bit 17 at the lower end of the string for drilling the well. Drilling fluid or mud is pumped downwardly through the string under pressure supplied by a mud pump 18 delivering the circulating fluid to the string through a line represented diagrammatically at 19, with the mud discharging from the lower end of the string at the location of bit 17, and then flowing upwardly within the annulus about the string to carry the cuttings to the surface for delivery through a line 20 to a cutting separating unit 21 from which the mud is recirculated through a line 22 to the mud pump 18. The drill string 13 is of a type which does not itself rotate within the well, but has a drilling unit 23 at its lower end containing a motor 24 (FIG. 2) for driving the bit. Above the location of drilling unit 23, the string includes a bent sub 25, an instrument section 26 and a fluid pressure transfer section 27. Reactive torque developed in the string above drilling unit 23 and as a result of the torque applied to the bit by drilling unit 23 is sensed by a torque responsive element 29, such as a strain guage, accelerometer or the like attached to the outer surface of and responsive to minor deformations of the drill pipe. A readout unit 30 responds to signals produced by the torque sensing element 29 to produce indications or other outputs representative of down hole data developed by instrument section 26. The upper end of the drill string, above sensor 29, may be retained against rotation, by a rotary table or other unit 28, to prevent reverse rotation of the string under the influence of the reactive torque of the motor and thereby assure development of a torque which can be sensed by element 29. A second sensor **29*a* may communicate with the interior of the drill string and the mud circulating downwardly therethrough, and sense the pressure of the mud and variations in that pressure to control a second readout unit 30*a*** for producing additional indications or outputs representing the down hole data.

The showing of FIG. 2 may be considered diagrammatic to the extent that for simplicity of illustration some parts which in actual manufacture would necessarily be formed sectionally of a number of component elements welded, screwed or otherwise secured together have been shown as single one-piece integral structures. The drawing has not been complicated by indicating the manner in which the parts so represented are assembled from components during manufacture.

As seen in FIG. 2, the instrument section 26 may have an outer rigid tubular wall 31 centered about the main longitudinal axis 32 of the pipe string and well and containing an inner concentric tubular wall 33 rigidly secured to the outer wall as by top and bottom walls 34 and 35, with a space or chamber 36 being formed radially between walls 31 and 33 and containing an instrument proper 37, a battery or batteries represented at 38, and electronic circuitry represented at 39. As seen in FIG. 5, the instrument containing chamber 36 extends only partially about inner tube 33, with two parallel axially extending fluid passages 40 and 41 being formed between tubes 31 and 33 at locations offset circularly from chamber 36. As will be brought out at a later point, high pressure hydraulic fluid flows downwardly through passage 40 to the motor of drilling unit 23, to drive that motor and the bit, with the fluid discharged from the motor flowing upwardly through passage 41 to pressure transfer section 27.

Where the instrument section 26 is to be utilized as a steering tool for determining the direction in which bent sub 25 and a bit should be directed, the instrument proper 37 may be of the type disclosed in U.S. Pat. Nos. 3,791,043 and 3,862,499 and include two or three gravity sensors 42 responsive to different components of inclination of section 26 with respect to the vertical, and two or three magnetic or other directional sensors 43 responsive to different components of compass direction. Signals produced by gravity sensors 42 provide information from which the actual inclination of the instrument relative to the vertical can be determined, while signals produced by sensors 43 provide information from which the direction of that inclination can be derived. The electronic circuitry 39 receives information from the sensors 42 and 43, and from a pressure sensitive transducer 138 (See FIG. 8) and produces a digital output in which the information sensed by elements 42, 43, and a pressure transducer 138 (FIG. 8) responsive to the fluid pressure in line 40, is multiplexed in a predetermined coding pattern, desirably utilizing a pulse width coding system as in the above identified prior patents, i.e. with the values which are sensed by elements 42, 43 and 138 being represented by varying time intervals between successive pulses. This multiplexed pulse stream from electronic circuitry 39 is employed to control changes in the condition of the bit driving motor in a manner altering the torque in the drill string and the pressure of the circulating mud therein and thereby enabling the information to be sensed at the surface of the form of variations of that torque or pressure.

Figure 6:
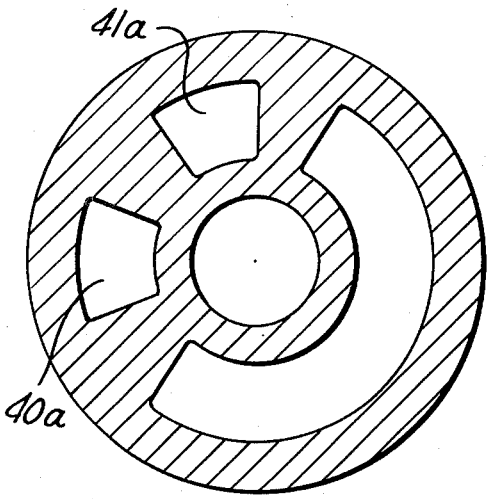

The cross section of bent sub 25 is illustrated in FIG. 6, and may correspond to the FIG. 5 cross section of instrument section 26, and contain two axially extending fluid passages **40*a* and 41*a* aligned with and forming continuations of the passages 40 and 41 of FIG. 5. This FIG. 6 cross section of the bent sub may continue for the entire length of the sub between its upper and lower ends. The bent sub is suitably rigidly connected to the lower end of the body of instrument section 26, as by means of a connector ring 44 which may have an annular shoulder bearing at 45 against a corresponding shoulder formed on the outer tubular body 31 of section 26, with internal threads of ring 44 engaging external threads on the outer surface of bent sub 25 at 46 to pull the bent sub tightly against section 26 by rotation of ring 44. A gasket 144 between the opposed surfaces of sections 25 and 26 forms an effective fluid tight seal about the meeting ends of the two passages 40 and 40*a* and a similar seal about the meeting ends of the two passages 41 and 41*a***, to prevent leakage of hydraulic fluid between the parts.

The fluid pressure transfer sub 27 which is connected into the string above instrument section 26 includes a tubular body 47 having an upper internally threaded box end 48 threadedly connected to the next upper section 15 of the string and containing a central vertical passage **49*a*** through which circulating mud received from the upper portion of the string flows downwardly.

At its lower end, the body 47 is connected rigidly to the body of instrument section 26, as by a threaded connector ring 50 corresponding to the previously described ring 44 and having threads engageable with body 47 at 51 to tighten a shoulder 52 of the ring upwardly against a coacting shoulder of section 26, with a seal gasket 53 provided between the parts to prevent fluid leakage therebetween. The lower end of central mud passage 49a of transfer sub 27 communicates with the previously mentioned mud passage 49 of the instrument section to deliver circulating fluid thereto.

At a location intermediate the upper and lower ends of mud passage 49a through pressure transfer sub 27, there is provided in passage 49a a choke 54 in the form of a disc extending across the passage and containing a central opening 55 forming a restricted passage for the mud through choke 54 acting to produce a substantial pressure drop across the choke. This choke 54 is carried by or formed integrally with a tubular valve element 56 which is rotatable about axis 32 relative to a tubular wall 57 of part 47 to control the communication of mud pressure above and beneath the choke to a pair of chambers 58 and 59 formed in body 47 at diametrically opposite locations. As seen in FIG. 3, these chambers 58 and 59 may be essentially semicylindrical, and contain two flexible diaphragms or bellows 60 and 61 which are peripherally bonded or otherwise secured to the body 47. A quantity of the secondary hydraulic fluid which drives the bit motor is contained within a compartment 62 to the left of diaphragm 60, and is isolated by that diaphragm from mud contained within a compartment 63 at the right of the diaphragm, but with the pressure of the mud being transmitted to the hydraulic fluid through the diaphragm. Similarly, diaphragm 61 isolates mud at its left side from hydraulic fluid at its right side while transmitting pressure therebetween.

At a location above the level of choke 54, sleeve valve 56 contains two diametrically opposed apertures 64 and 65 through which the mud pressure can flow into the two compartments 63 and 66. In the FIGS. 2 and 3 rotary position of the valve, aperture 65 is aligned with an opening 67 in wall 57 to pass the mud pressure into compartment 66 and against diaphragm 61, while aperture 64 is opposite an imperforate portion of wall 57 and thus cannot pass the mud pressure above the choke into compartment 63. In the same position of the valve, the mud pressure beneath choke 54 flows through an aperture 68 in the sleeve and an aligned opening 69 in wall 57 into compartment 63 and against diaphragm 60, while a diametrically opposite aperture 70 of the sleeve beneath choke 54 is opposite an imperforate portion of wall 57 to block off any communication from beneath the choke with compartment 66. Thus, in this condition of the valve, a greater pressure is applied to compartment 66 than to compartment 63, to thereby apply a greater pressure to the secondary fluid within chamber 71 than to the secondary fluid within chamber 62.

Valve element 56 can be rotated in a counterclockwise direction as viewed in FIG. 3 through approximately 90° from the position of FIGS. 2 and 3 to a second setting in which aperture 64 of the sleeve valve is aligned with an opening 72 in wall 57 to pass the mud pressure above the choke into compartment 63, while aperture 68 is opposite an imperforate portion of wall 57 and blocks off communication between the area beneath the choke and compartment 63. In that changed condition, aperture 65 is moved to a position opposite an imperforate portion of wall 57, while aperture 70 is moved into alignment with an opening 73 (FIG. 3) in wall 57, so that this second setting of the rotary valve the pressure above the choke is applied to compartment 63 and diaphragm 60, while the lower pressure beneath the choke is applied to compartment 66 and diaphragm 61.

Figure 8:
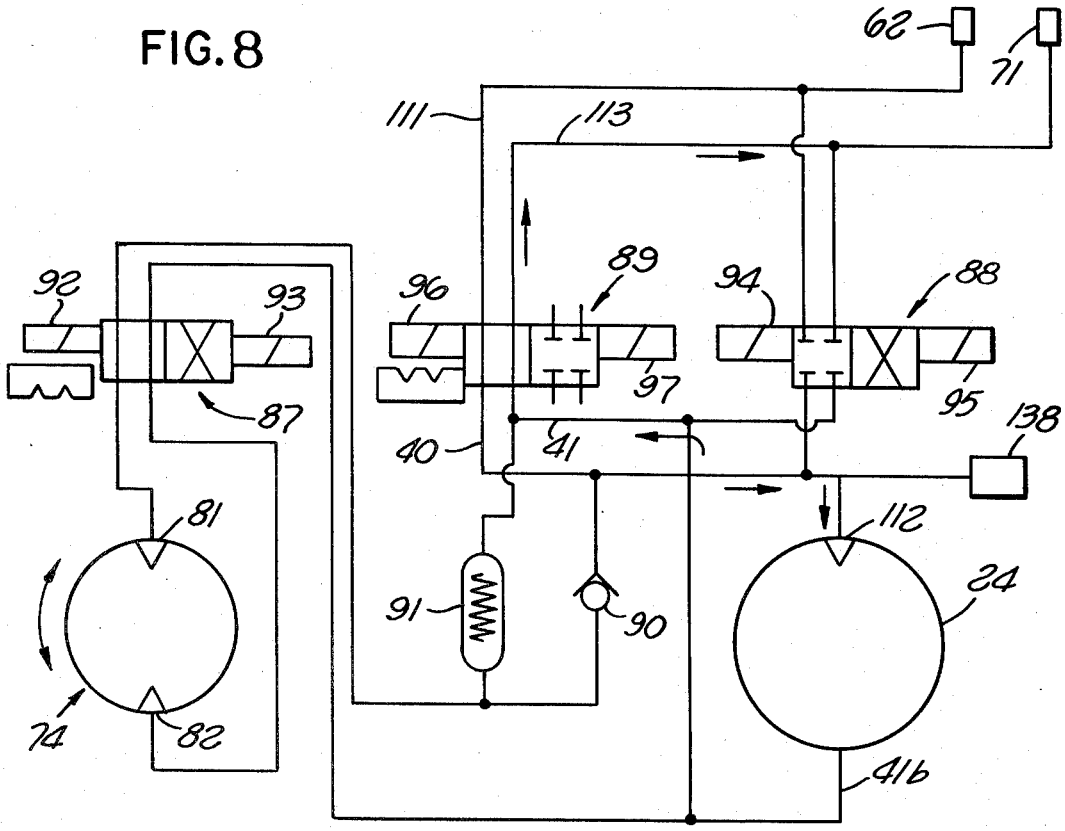
FIG. 8 is a diagram representing the hydraulic circuit of the apparatus.

Valve 56 is oscillated rotatively between these two settings by a hydraulic rotary actuator 74 (FIG. 4), which is illustrated as consisting of a portion 75 of body 47 containing and defining a semicircular compartment 76 within which a vane 77 is movable rotatively about axis 32 through approximately 90°. Vane 77 may be carried by a tubular shaft 78 forming a lower extension of the tubular sleeve valve 56 and defining the radially inner side of the compartment 76. above and beneath compartment 76, portion 75 of body 47 forms top and bottom walls 79 and 80 which complete the enclosure of compartment 76. As will be understood, the secondary hydraulic fluid is admissible into compartment 76 at oppostie sides of vane 77 tnrough two inlet and outlet openings 81 and 82 in bottom wall 80 of the rotary actuator device. When fluid is admitted through inlet 81 and discharged through outlet 82, the fluid pressure acts to move vane 77 in a clockwise direction as viewed in FIG. 4, and similarly when fluid is admitted through opening 82 and discharged through opening 81 the vane movement is in a counterclockwise direction. The passages 81 and 82 communicate with valving apparatus within a compartment 83 contained in body 47 beneath the rotary actuator 74. Similarly, the two variable size compartments 62 and 71 at the outer sides of the diaphragms communicate through two passages 84 and 85 respectively with the apparatus in lower compartment 83. Pressurized hydraulic fluid from the apparatus in compartment 83 is delivered through aligned passages 86 in sections 27 and 26 and into passage 40 leading to the motor, while pressure fluid from passage 41 in instrument section 26 flows upwardly through passages in sections 27 and 26 corresponding to the passages 86 illustrated in FIG. 2 but offset circularly therefrom to return low pressure from the motor to the apparatus in compartment 83. The elements within compartment 83 include a solenoid actuated reversing valve 87 (FIG. 8), two solenoid actuated on-off valves 88 and 89, a check valve 90, an accumulator 91, and the previously mentioned pressure responsive transducer 138, all interconnected in the hydraulic circuit illustrated in FIG. 8. Valve 87 is actuable leftwardly as seen in FIG. 8 by energization of a solenoid 92, and is actuable rightwardly by a solenoid 93. Similarly, valves 88 and 89 are actuable leftwardly by solenoids 94 and 96 respectively and rightwardly by solenoids 95 and 97 respectively. The six solenoids are connected electrically to the electronic circuitry 39 of instrument package 36, and are actuable thereby in a timing pattern corresponding to and representative of the data sensed by sensors 42, 43 and 138. The timing of such actuation of the solenoid valves will be discussed in greater detail at a later point.

Figure 7:
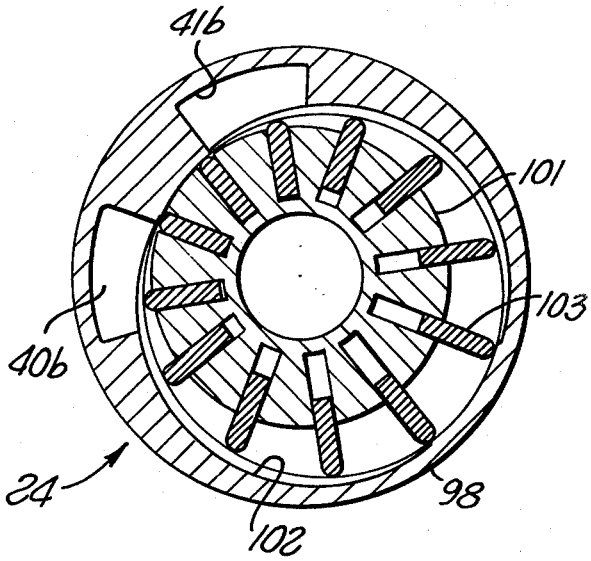

Referring now to FIG. 7, the motor 24 for driving bit 17 may be a rotary vane type motor driven by the pressure of the secondary hydraulic fluid. The stator of this motor is typically illustrated as formed by a portion of an outer tubular section 98 of drilling unit 23. This outer body 98 of unit 23 is appropriately rigidly secured to the lower end of the bent sub, as by means of a threaded retaining ring 99 corresponding to the previously mentioned rings 44 and 50, with a gasket 100 forming a seal between opposed faces of the parts. The body 98 contains passages communicating in sealed relation with the two passages 40*a* and 41*a* of the bent sub, and leading pressure fluid to and from opposite sides of the vane motor 24. The rotor of the motor is represented at 101 in FIGS. 7 and 2, and is rotatable about axis 32*a* of the drilling unit 23 within a cylindrical compartment 102 formed in body 98 and eccentric with respect to axis 32*a*. Vanes 103 are received within guiding grooves in rotor 101 and are radially movable relative thereto to form a series of compartment between successive vanes which progressively enlarge in advancing from an inlet 40*b* to an outlet 41*b*. As will be understood, these passages 40*b* and 41*b* communicate respectively with the passages 40*a* and 41*a* in the bent sub with seals thereabout formed by gasket 100. Pressure fluid delivered to inlet 40*b* of the vane motor drives that motor rotatively about axis 32*a*, with the fluid discharging at a reduced pressure through outlet 41*b*. The fluid space 102 within part 98 may be closed at its upper and lower ends by a pair of end walls 104 and 105 constituting portions of or carried by body 98. Rotor 101 is connected at its lower end to or formed integrally with a downwardly projecting tube 106, which carries a head 107 containing internal threads 108 to which the bit 17 is connectible. Tube 106 and the rotor 101 of vane motor 24 are journalled for rotation about axis 32*a* relative to outer body 98 of the drilling unit by suitable bearing means, typically illustrated as including a sleeve bearing 109 engaging the outer cylindrical bearing surface of tube 106 and a thrust bearing 110 for transmitting downward drilling forces from body 98 to the bit carrying head 107.

To discuss now the operation of the form of the invention illustrated in FIGS. 1 to 9, assume that drill string 13 is positioned in a well as illustrated in FIG. 1, and that the instrument package 26 is operating to produce a multiplexed train of electrical pulses in a pulse width coded pattern so that the intervals between successive pulses are determined by the inclination and directional components sensed by sensors 42 and 43 and the fluid pressure sensed by transducer 138 (which pressure is a measure of the torque applied to the bit by motor 24). These data pulses are then utilized to energize solenoids 92 through 97 in the pattern illustrated in the timing diagram of FIG. 9. At the point designated time zero in that diagram, it may be assumed that the solenoid valves are in the condition illustrated in FIG. 8, and that the rotary mud valve 56 is in a setting in which the higher mud pressure above choke 54 is communicated to diaphragm 60 and the lower mud pressure beneath the choke is communicated to diaphragm 61. The secondary liquid pressure in chamber 62 is thus greater than the pressure in chamber 71, and as indicated in FIG. 8 the greater of these pressures from chamber 62 flows through a line 111 and valve 89 to passage 40 in the instrument package, and then through passages 40*a* and 40*b* to the inlet side 112 of vane motor 24. This fluid drives the motor and bit rotatively in a direction to drill, with the fluid discharging from the motor through lines 41*b* and the communicating lines 41*a* and 41 and valve 89 and then through a line 113 to the lower pressure chamber 71 at the right side of diaphragm 61. The diaphragms 60 and 61 therefore gradually move leftwardly as viewed in FIG. 2 and by such movement cause flow of the secondary fluid in a manner driving the motor 24 and bit 17 rotatively. With the motor turning in this direction from time zero in FIG. 9, the first pulse which is delivered from electronic circuitry 39 of the instrument sub 26 to the solenoid valves in the pulse 114 of FIG. 9, which energizes solenoid 96 to shift valve 89 leftwardly and thus interrupt the flow of secondary fluid to and from the motor and interrupt the application of torque to the rotor of the motor by the fluid. The next successive pulse is represented at 115 in FIG. 9, and acts to energize solenoid 92 to reverse the connections from passages 40 and 41 to the rotary actuator 74. Until such reversal and with the valve 87 in its FIG. 8 condition, the initially higher pressure passage 40 is in communication with a first of the inlets 81 of actuator 74, while the lower pressure passage 41 is in communication with the second side 82 of the valve actuator 74, to thereby urge the vane 77 of actuator 74 in a predetermined rotary direction maintaining valve 56 in the discussed setting in which a higher pressure is maintained in compartments 62 and 63 than in compartments 66 and 71. When the valve 87 is reversed by pulse 115 of FIG. 9, this acts to reverse the connections to actuator 74 and cause rotary movement of its vane 77 to the second of its previously discussed settings, in which the higher mud pressure above choke 54 is delivered to compartment 66 of FIG. 2 and the lower pressure beneath the choke is delivered to compartment 63, to thereby tend to induce rightward movement of diaphragms 60 and 61 in FIG. 2. The next successive pulse 116 is delivered to solenoid 94 and acts to shift valve 88 leftwardly and connect compartments 62 and 71 to the motor but in a reversed condition as compared to the initially described condition in which these compartments were connected to the motor through valve 89. More particularly, the chamber 71 is then connected to the high pressure side of the motor, and the chamber 62 is connected to the discharge side of the motor so that the motor continues to turn in the same direction as when fluid was delivered thereto through valve 89. Such rightward movement of the diaphragms and rotation of the motor and bit continues until the next successive pulse 117 is delivered to solenoid 95 to close valve 88 and terminate the delivery of secondary fluid to the motor, following which pulse 118 delivered to solenoid 93 returns the mud valve back to its FIG. 8 condition to tend to induce leftward movement of the diaphragms, with a next successive pulse 119 energizing solenoid 97 to again open valve 89 and deliver pressurized secondary fluid to and from the motor for continued rotation still in the same direction. The next successive series of pulses 114*a*, 115*a* and 116*a* are in the same sequence as and correspond to the discussed pulses 114, 115 and 116, and are followed by pulses 117*a*, 118*a* and 119*a* corresponding to pulses 117, 118 and 119, with this entire sequence repeating through many cycles to drive the motor almost continously.

Figure 9:
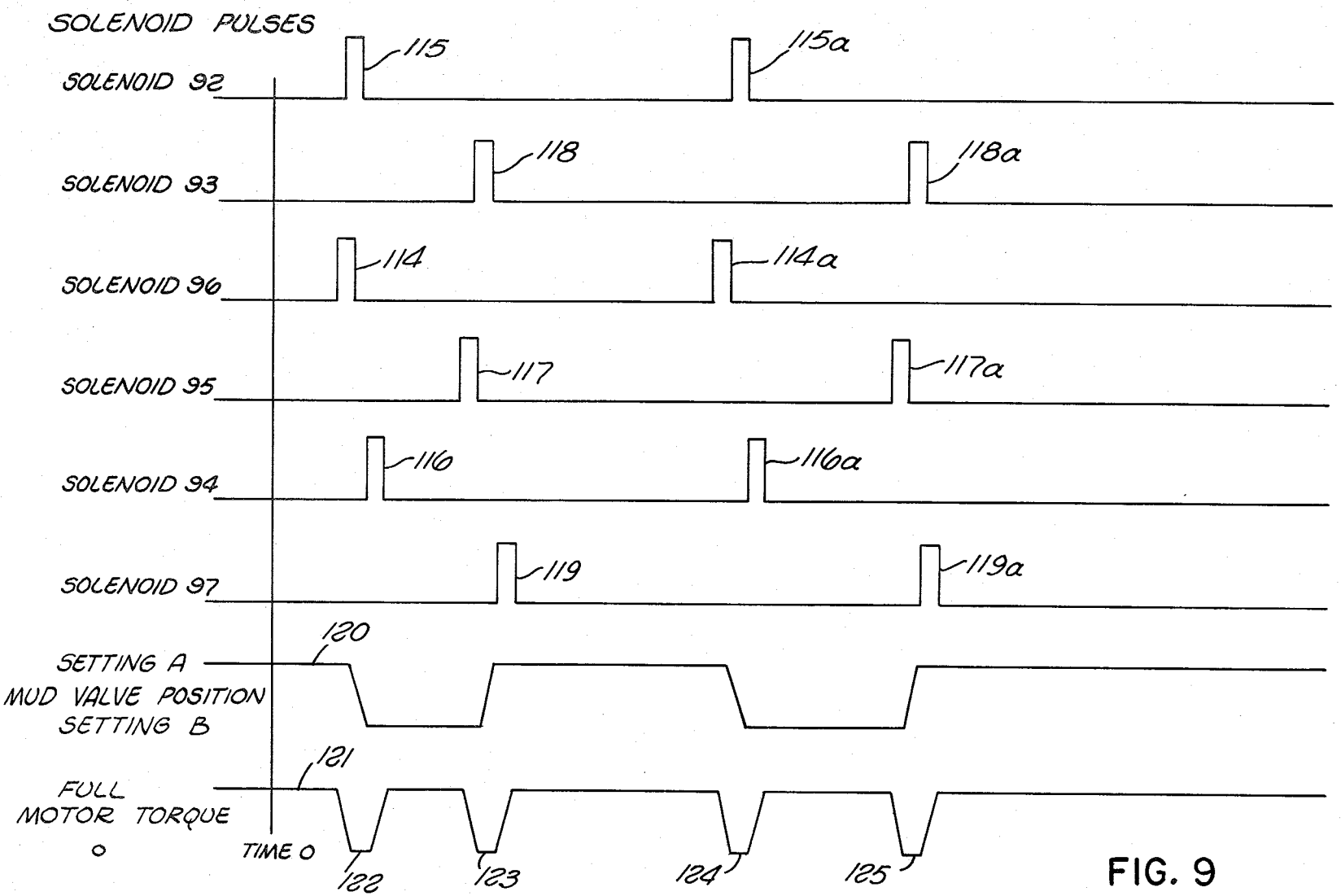
FIG. 9 is a timing diagram for the motor assembly.
Figure 10:
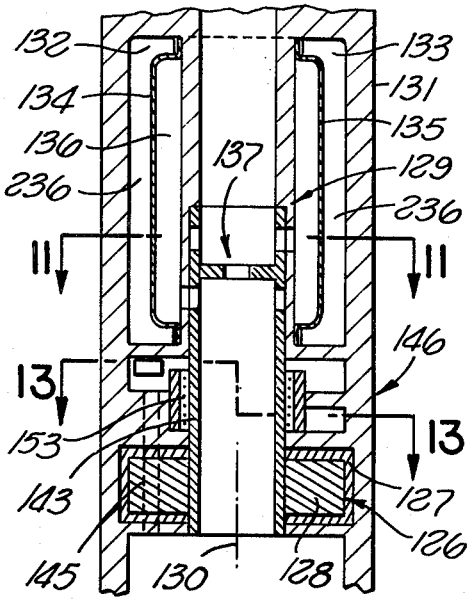
FIG. 10 is a vertical sectional view corresponding to a portion of FIG. 2, and representing fragmentarily a variational form of the invention.
Figure 11:
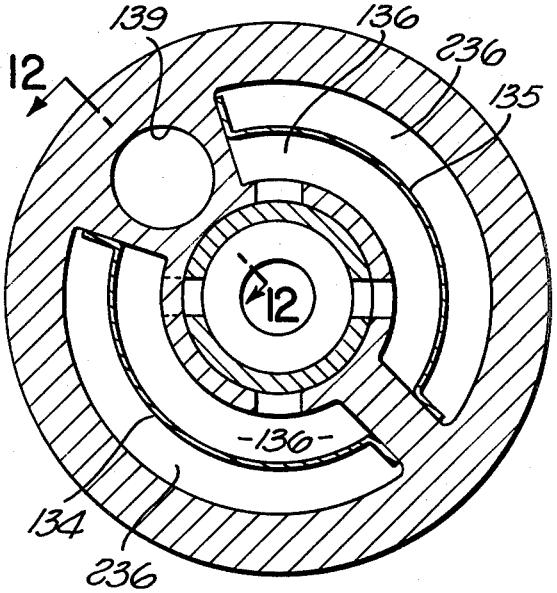
FIG. 11 is a horizontal section taken on 11—11 of FIG. 10.
Figure 12:
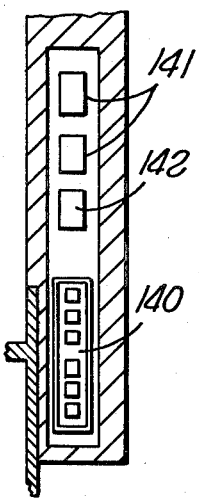
FIG. 12 is a fragmentary vertical section taken on line 12—12 of FIG. 11.

The curve 120 of FIG. 9 represents the changes in position of mud valve 36 between its two different rotary settings, with those settings being designated by the levels labelled "Setting A" and "Setting B". The pulses 115, 118, 115*a* and 118*a*, etc. are the pulses which cause the reversals of mud valve position. The lower curve of FIG. 9 represents the torque which is applied to the motor and bit as the valves are actuated by the data pulses from the instrument. The full torque is represented at a level 121 in FIG. 9 and reduction in the motor torque delivered to the bit is encountered at the point 122, and continues between pulses 114 and 116, since pulse 114 results in all delivery of fluid to the motor being closed off, until pulse 116 again allows fluid to flow to the motor through valve 88. Similarly, at the location 123, the motor torque drops between pulses 117 and 119, and corresponding zero torque intervals occur at the points 124 and 125 of FIG. 9. It is further noted that reversal of the mud valve by pulse 115, 118, 115*a* or 118*a* occurs during the zero torque intervals and while the flow of mud through the apertures of mud valve 56 is terminated by reason of the inability of the diaphragm to deliver any fluid to the motor. The mud valve is thus protected against abrasion by flow therethrough during the intervals while that valve is being reversed.

The time interval which elapses between pulse 114 and pulse 117 is controlled by the electronic circuitry to represent in analog fashion one of the inclination or direction components sensed by sensors 42 and 43 of instrument 37. Similarly, the time interval which elapses between pulse 117 and pulse 114*a* represents another inclination or direction component or other bit of information developed by the instrument. The same is true of the time interval between pulses 114*a* and 117*a*, and between successive similar pulses in the multiplexed pulse stream. Consequently, the time intervals between the reductions in torque at locations 122, 123, 124, 125, etc. are direct analog representations of the data developed by the instrument.

Each time that the motor torque drops to zero as represented at 122, 123, etc. the torque applied to the bit is zero, and also the reactive torque applied by the motor to the bent sub and to the string thereabove drops to zero. This decrease in torque is sensed by element 29 at the surface of the earth which delivers electrical signals corresponding to the torque pulses 122, 123, etc. to readout unit 30 which in turn processes those torque signals to produce indications of the inclination and direction components sensed by the down hole instrument, or through appropriate computer circuitry combines those components to produce direct indications of the actual inclination and azimuth of the inclination, or produces any of various other types of electrical, visual or recorded output dependent upon or representative of the down hole data.

The changes in torque applied by the motor to the bit, besides producing reactive torque pulses in the drill string, also cause variations in the pressure of the circulating mud within the string. More particularly, each time the motor torque and reactive torque reduce to zero, at 122, 123, 124, 125, etc., there is a corresponding increase in the pressure of the mud within the string. Pressure sensor 29*a* at the surface of the earth senses these mud pressure pulses, and delivers corresponding multiplexed pulse width coded signals to readout unit 30*a*, which processes those signals to produce indications of the inclination and direction components sensed in the well, or combines the components to represent the true inclination or azimuth directly or produces other outputs dependent upon or representing the down hole data.

The two readouts 30 and 30*a* may be employed separately or together, and may be utilized to produce either corroborating indications of the same information or entirely different types of outputs which may be desired for a particular installation.

The system described thus provides effective telemetry of information to the surface of the earth without use of a wire line for electrically conducting information upwardly within the well. Also, the motor arrangement provides a very effective drive to the bit by energy derived from the pressure of the circulating mud, but without permitting that mud to directly contact the working parts of the motor.

FIGS. 10 through 13 illustrate fragmentarily a variational form of the invention which may be considered as identical with the arrangement of FIGS. 1 to 9 except with regard to the changed features specifically illustrated in FIGS. 10 through 13. In this second form of the invention, the solenoid actuated on-off valves 88 and 89 of FIG. 8 are eliminated and there is substituted a rotary valve assembly 126 having an outer essentially annular body part 127 and a relatively rotatable valve element proper 128 connected to the mud valve 129 for rotation therewith about the main longitudinal axis 130 of the instrument portion of the tool. The tool body 131 contains two chambers 132 and 133 similar to chambers 58 and 59 of the first form of the invention and within which there are positioned two flexible diaphragms 134 and 135 corresponding to diaphragms 60 and 61 of the first form of the invention and dividing chambers 132 and 133 into inner mud chambers 136 and outer secondary fluid chambers 236 sealed from one another. The construction and functioning of mud valve 129 and choke 137 may be the same as the mud valve and choke of the first form of the invention.

Circularly between the two approximately semicylindrical chambers 132 and 133, the body 131 of the tool may contain a vertically enlongated chamber 139 within which instrument 140, batteries 141 and electronic circuitry 142 may be contained, corresponding to the elements 37, 38 and 39 respectively of FIG. 2. The tubular rotary valving sleeve 143 of mud valve 129 extends downwardly farther than in FIG. 2, for rigid attachment to the rotary valving element 128. The body 127 and inner element 128 of valve unit 126 contains passages represented diagrammatically at 145 and which function to make and break connections from lines 111 and 113 of FIG. 8 to lines 40 and 41 of that figure in exactly the same sequence and timing as do solenoid actuated valves 88 and 89 in the FIG. 8 arrangement, so that the overall functioning of the hydraulic circuit is exactly the same in FIGS. 10 through 13 as in FIGS. 1 through 9 but with substitution in the second form of the invention of a rotary valve for the solenoid valves 88 and 89. Since rotary valves are well known in the art, the present disclosure will not be complicated by specific illustration of the arrangement of the valving passages 145 in the rotary valve.

The sleeve 143 which is integral with and operates the mud valve 129 and secondary fluid valve element 128 is oscillated rotatively between two different valving conditions by a rotary actuator 146 similar to the actuator 74 of FIG. 2. This unit 146 includes a vane 147 (FIG. 13), carried by a cylindrical body 148 and adapted to oscillate rotatively between the full line position of FIG. 13 and the broken line position of that figure. Pressure fluid is admitted to opposite sides of the vane 147 through inlet and outlet passages 149 and 150 which may communicate with the chamber 151 within which the fluid is received through restrictions 152. Torque is transmitted yieldingly from sleeve 148 of the valve actuator to the sleeve 143 of the valves through two torsion springs one of which is illustrated at 153 in FIG. 13. This spring has a first of its ends connected at 154 to sleeve 148 and a second of its ends connected at 155 to the inner valve actuating sleeve 143. Spring 153 extends in a clockwise direction from its point of attachment to sleeve 148 to its point of attachment to sleeve 143, while the second spring (not shown) extends in a counterclockwise direction from its point of attachment to the outer sleeve 148 to its point of attachment to the inner sleeve 143. The two springs thus effectively transmit torque in opposite directions but yieldingly and with lost motion. Two solenoids 156 and 157 which are energized by the signals from electronic circuit 142 actuate detent elements 158 into and out of the arcuate path of movement of a coacting detent element 159 attached to sleeve 143. The element 158 actuable by solenoid 156 acts to releasably retain detent part 159 in the full line position of FIG. 13, while the second solenoid is operable to releasably retain element 159 in the broken line position represented at 159*a* in FIG. 13.

Figure 13:
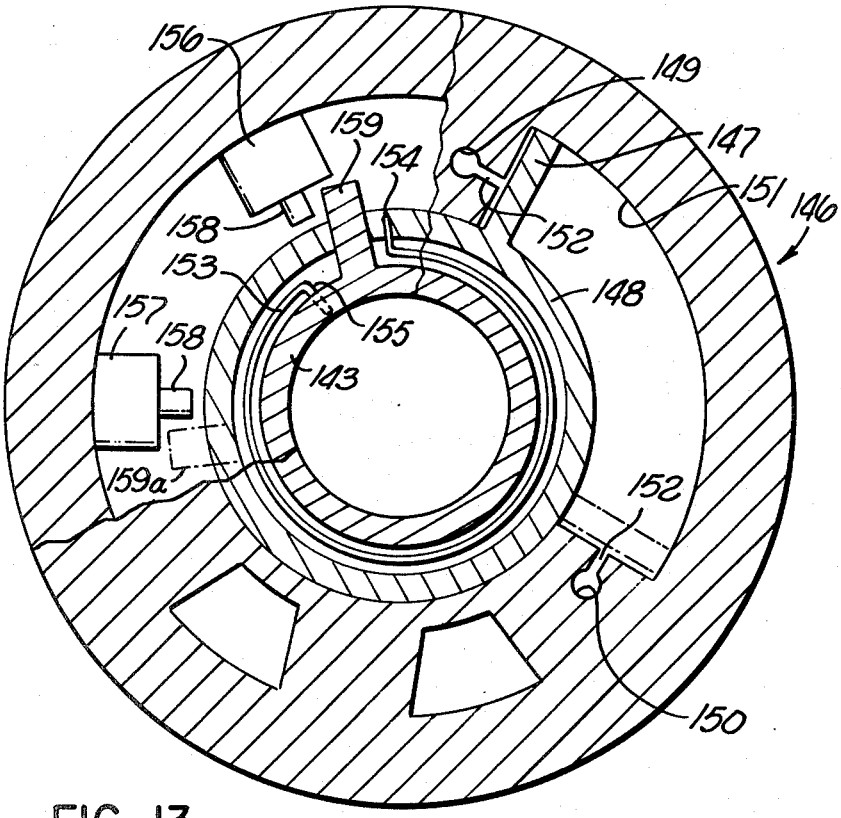
FIG. 13 is a horizontal section taken on line 13—13 of FIG. 10.

During clockwise movement of vane 147 of the rotary actuator 146 from the full line position to the broken line position of FIG. 13, detent element 159 is retained in its broken line position of FIG. 13 by solenoid 157 until a signal to be transmitted to the surface of the earth is delivered to that solenoid causing it to release element 159 and permit rapid clockwise movement of that element and valving sleeve 143 from the broken line position to its full line position of FIG. 13 under the influence of the torsion springs 153. During such movement, the solenoid 156 is in its released condition permitting element 159 to move beyond the movable element 158 of solenoid 156. When vane 147 moves in the opposite direction, from the broken line position of FIG. 13 to the full line position of that figure, a torsional force is again built up in the springs, while detent 159 is retained in its full line position by the movable element 158 of solenoid 156, until a next successive electrical pulse or signal from electronic circuit 142 energizes the solenoid 156 to release element 159 for counter-clockwise movement reversing the condition of the valves. The restrictions 152 in the fluid passages leading into chamber 151 of the rotary actuator prevent premature movement of vane 147 before the solenoids can be actuated to a proper condition at the end of a rotary valving motion.

During each interval of movement of detent element 159 from its full line position of FIG. 13 to its broken line position, or vice versa, the valve 26 acts first to interrupt the delivery of all secondary fluid to the motor, and thereby break the drive to the motor for as long as it takes to reverse the mud valve, following which delivery of secondary fluid to the motor is again commenced but in a reverse flow pattern after the mud valve has been completely reversed, all in the same sequence as in the first form of the invention.

While certain specific embodiments of the present invention have been disclosed as typical, the invention is of course not limited to these particular forms, but rather is applicable broadly to all such variations as fall within the scope of the appended claims.

I claim:

1. Drilling apparatus for use with a drill string which extends into a well and carries a bit and within which a circulation of drilling fluid is maintained along a predetermined path, comprising:

a fluid motor in the well adapted to rotate the bit and which is driven by a secondary fluid isolated from said drilling fluid;

means exposed to the pressure of said drilling fluid and energized thereby to produce a flow of said secondary fluid through the motor for turning the bit;

a choke in said drill string through which the drilling fluid flows;

said means exposed to the pressure of the drilling fluid at opposite sides respectively of said choke and applying different pressures to said secondary fluid producing said flow thereof through the motor;

valve means operable between a first condition in which a first of said movable walls is exposed to the pressure of drilling fluid at the upstream side of said choke and the second movable wall is exposed to the pressure of drilling fluid at the downstream side of said choke and a second condition in which said first movable wall is exposed to the pressure of drilling fluid at the downstream side of the choke and said second movable wall is exposed to the pressure of drilling fluid at the upstream side of said choke;

means for reversing secondary fluid connections to said motor when said valve means are actuated between said two conditions thereof;

said valve means being rotatable between said conditions thereof and about an axis extending essentially longitudinally of said drill string; and a vaned fluid operated rotary actuator connected to said valve means and operable by fluid pressure to rotate the valve means between said first and second conditions.

2. Drilling apparatus for use with a drill string which extends into a well and carries a bit and within which a circulation of drilling fluid is maintained along a predetermined path, comprising:

a fluid motor in the well adapted to rotate the bit and which is driven by a secondary fluid isolated from said drilling fluid;

means exposed to the pressure of said drilling fluid and energized thereby to produce a flow of said secondary fluid through the motor for turning the bit;

a choke through which the drilling fluid flows, said means including two movable walls adapted to be exposed to the pressure of drilling fluid at opposite sides of said choke and applying different pressures to said secondary fluid producing said flow thereof through the motor, first rotary valve means for controlling delivery of drilling fluid at opposite sides of the choke to said movable walls in a relation moving said walls alternately in opposite directions, and second rotary valve means connected to said first rotary valve means to turn therewith and operable to reverse secondary fluid connections to said motor;

a rotary actuator for rotatively oscillating said first and second valve means;

spring means yielding connecting said actuator to said first and second valve means;

detent means for releasably retaining said first and second valve means against movement by said actuator; and an instrument controlling actuation of said detent means.

3. Drilling apparatus for use with a drill string which extends into a well and carries a bit and within which a circulation of drilling fluid is maintained along a predetermined path, comprising:

a fluid motor in the well adapted to rotate the bit and which is driven by a secondary fluid isolated from said drilling fluid;

means exposed to the pressure of said drilling fluid and energized thereby to produce a flow of said secondary fluid through the motor for turning the bit;

a choke through which the drilling fluid flows, said means including two movable walls adapted to be exposed to the pressure of the drilling fluid at locations upstream and downstream respectively of said choke and applying different pressures to said secondary fluid producing said flow thereof through the motor, and a tubular valve structure rotatable about an axis extending essentially longitudinally of said drill string and carrying said choke at a location between opposite ends of said valve structure, said tubular valve structure containing valving openings upstream and downstream of said choke and operable in a first rotary position of the valve structure to communicate the pressure of the drilling fluid upstream of the choke to a first of said movable walls and the pressure of the drilling fluid downstream of the choke to the second of said movable walls, and in a second rotary position to communicate the pressure of the drilling fluid downstream of the choke to said first movable wall and the pessure of the drilling fluid upstream of said choke to the second movable wall, and actuating means for oscillating said tubular valve structure rotatively between said two positions thereof.

4. Drilling apparatus as recited in claim 3, in which said actuating means include a vaned fluid operated rotary actuator containing a passage through which said drilling fluid flows and connected to said valve structure and operable by fluid pressure to rotate the valve structure between said first and second positions thereof.

5. Drilling apparatus as recited in claim 4, including additional valve means operable to reverse connections between secondary fluid chambers adjacent said movable walls and said motor each time that said valve structure is rotated between said positions thereof, to maintain rotation of the motor in the same direction when said valve structure is in said two different positions.

6. Drilling apparatus as recited in claim 5, including an instrument to be contained within the well and produce signals representing data to be communicated to the surface of the earth, and means responsive to said signals to actuate said first mentioned valve means and said additional valve means in correspondence with said data.

7. Drilling apparatus for use with a drill string which extends into a well within which a circulation of drilling fluid is maintained to carry cuttings to the surface of the earth, comprising:

a bit carried at the end of the drill string for drilling the well;

a fluid motor in the well for rotating the bit and which is driven by a secondary fluid isolated from the drilling fluid;

a choke in the drill string through which the drilling fluid flows with a pressure drop across the choke;

means forming two drilling fluid chambers to be exposed to the pressure of said drilling fluid at opposite sides of the choke;

first reversing valve means rotatable between a first position communicating the drilling fluid pressure upstream of the choke to a first of said drilling fluid chambers and communicating the pressure downstream of the choke to a second of said drilling fluid chambers, and a second position communicating the drilling fluid pressure upstream of the choke to the second chamber and the drilling fluid pressure downstream of the choke to the first chamber;

two flexible diaphragms exposed at first sides to the pressures in said two drilling fluid chambers respectively and at second sides to two secondary fluid chambers respectively to apply the differential pressure between opposite sides of the choke to said two secondary fluid chambers;

second reversing valve means operable in a first condition to deliver secondary fluid from a first of said secondary fluid chambers to the inlet of said motor and return secondary fluid from the outlet of the motor to the second of the secondary fluid chambers, and operable in a second condition to reverse the connections and deliver fluid to the motor from said second secondary fluid chamber and return it to said first secondary fluid chamber, said second valve means being operable through an intermediate condition in which fluid does not flow from either of the secondary fluid chambers to the motor;

an instrument in the well adapted to produce signals representative of data to be transmitted to the surface of the earth;

a fluid operated rotary actuator for turning said first reversing valve means between said positions thereof;

means responsive to said signals to actuate said rotary actuator and said first reversing valve means between said positions of the latter in correspondence with said signals, and operable upon such actuation of the first reversing valve means to reverse said second valve means, with the second valve means being in said intermediate off position during actuation of the first reversing valve means between its different positions; and means near the surface of the earth operable to sense changes in torque in the drill string resulting from alterations in the operation of said motor upon actuation of said first reversing valve means and said second reversing valve means and acting to produce an output representative of said data.

8. Drilling apparatus for use with a drill string which extends into a well within which a circulation of drilling fluid is maintained to carry cuttings to the surface of the earth, comprising:

a bit carried at the end of the drill string for drilling the well;

a fluid motor in the well for rotating the bit and which is driven by a secondary fluid isolated from the drilling fluid;

a choke in the drill string through which the drilling fluid flows with a pressure drop across the choke;

means forming two mud chambers to be exposed to the pressure of said drilling fluid at opposite sides of the choke;

first reversing valve means rotatable between a first position communicating the mud pressure upstream of the choke to a first of said drilling fluid chambers and communicating the pressure downstream of the choke to a second of said drilling fluid chambers, and a second position communicating the drilling fluid pressure upstream of the choke to the second chamber and the drilling fluid pressure downstream of the choke to the first chamber;

two flexible diaphragms exposed at first sides to the pressures in said two drilling fluid chambers respectively and at second sides to two secondary fluid chambers respectively to apply the differential pressure between opposite sides of the choke to said two secondary fluid chambers;

second reversing valve means operable in a first condition to deliver secondary fluid from a first of said secondary fluid chambers to the inlet of said motor and return secondary fluid from the outlet of the motor to the second of the secondary fluid chambers, and operable in a second condition to reverse the connections and deliver fluid to the motor from said second secondary fluid chamber and return it to said first secondary fluid chamber, said second valve means being operable through an intermediate condition in which fluid does not flow from either of the secondary fluid chambers to the motor;

an instrument in the well adapted to produce signals representative of data to be transmitted to the surface of the earth;

a fluid operated rotary actuator for turning said first reversing valve means between said positions thereof;

and means responsive to said signals to actuate said rotary actuator and said first reversing valve means between said positions of the latter in correspondence with said signals, and operable upon such actuation of the first reversing valve means to reverse said second valve means, with the second valve means being in said intermediate off position during actuation of the first reversing valve means between its different positions; and means near the surface of the earth operable to sense changes in drilling fluid pressure resulting from alterations in the operation of said motor upon actuation of said first reversing valve means and said second reversing valve means and acting to produce an output representative of said data.

* * * * *